US011614256B2

(12) United States Patent
Akella et al.

(10) Patent No.: US 11,614,256 B2
(45) Date of Patent: Mar. 28, 2023

(54) PNEUMATICALLY ACTUATED LOUVER FOR AIR CONDITIONER UNIT

(71) Applicant: Haier US Appliance Solutions, Inc., Wilmington, DE (US)

(72) Inventors: Sainath Akella, Louisville, KY (US); Nitinkumar Hulsure, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 443 days.

(21) Appl. No.: 16/734,542

(22) Filed: Jan. 6, 2020

(65) Prior Publication Data

US 2021/0207842 A1 Jul. 8, 2021

(51) Int. Cl.
*F24F 13/14* (2006.01)
*F24F 1/0011* (2019.01)

(52) U.S. Cl.
CPC ..... *F24F 13/1426* (2013.01); *F24F 1/0011* (2013.01); *F24F 2013/1466* (2013.01)

(58) Field of Classification Search
CPC ..... F24F 1/0011; F24F 2013/1466; F24F 13/1426; F24F 13/20
See application file for complete search history.

(56) References Cited

U.S. PATENT DOCUMENTS 5,044,260 A * 9/1991 Avari ..... F24F 1/005 454/316
5,626,517 A * 5/1997 Kil ..... F24F 11/83 454/319
6,330,807 B1 * 12/2001 Correa ..... F24F 13/20 62/262
6,729,154 B2 * 5/2004 Takashima ..... B01D 46/58 55/284
8,047,016 B2 * 11/2011 Jeon ..... F24F 1/0011 62/426
2004/0171345 A1 * 9/2004 Pesch ..... B60H 1/345 454/319
2010/0314569 A1 * 12/2010 Hildreth, Jr. ..... F24F 13/1426 251/212
2019/0376709 A1 * 12/2019 Fieldhouse ..... F24F 13/1413
2021/0018217 A1 * 1/2021 Carey ..... F24F 13/1486

FOREIGN PATENT DOCUMENTS

JP S6370042 A 3/1988
JP 8094165 A 4/1996
KR 20160170533 A * 12/2016

OTHER PUBLICATIONS

JPH0792271B2 mt (Year: 1994).*
KR20160170533A mt (Year: 2016).*

* cited by examiner

*Primary Examiner* — Gordon A Jones
(74) *Attorney, Agent, or Firm* — Dority & Manning, P.A.

(57) ABSTRACT

An air conditioner unit includes a blower fan. The blower fan includes a blade assembly and a motor connected to the blade assembly. The air conditioner unit also includes an inlet grille upstream of the blower fan and an outlet grille downstream of the blower fan. The air conditioner unit further includes an automatic louver assembly operatively connected to the outlet grille whereby air flowing through the outlet grille is directed in a first direction when the automatic louver assembly is in a first position and the air flowing through the outlet grille is directed in a second direction when the automatic louver assembly is in a second position.

16 Claims, 7 Drawing Sheets

PNEUMATICALLY ACTUATED LOUVER FOR AIR CONDITIONER UNIT

FIELD OF THE INVENTION

The present disclosure relates generally to air conditioner units, and more particularly to methods and apparatus for directing air flow from air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

In many currently known air conditioner units, the air blown into the room through the air outlet may be directed or distributed throughout the room by a louver mechanism which is electromechanically actuated. Such louver mechanisms may increase the energy consumption of the air conditioner unit.

Accordingly, improved methods and apparatus for operating air conditioner units are desired. In particular, methods and apparatus that provide automatic louvers without significant increase in electric consumption would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit defines a vertical direction, a lateral direction, and a transverse direction. The vertical direction, the lateral direction, and the transverse direction are mutually perpendicular. The air conditioner unit includes an inlet grille and an outlet grille providing fluid communication between an indoor portion of the air conditioner and an ambient environment. The air conditioner unit also includes a blower fan positioned in the indoor portion of the air conditioner unit. The blower fan is operable to urge air into the indoor portion of the air conditioner unit through the inlet grille and to urge air out of the indoor portion of the air conditioner unit through the outlet grille. The air conditioner unit also includes an automatic louver assembly operatively connected to the outlet grille and movable along the lateral direction between a first position and a second position. The automatic louver assembly is configured to direct the air out of the indoor portion of the air conditioner unit through the outlet grille in a first direction when the automatic louver assembly is in the first position and to direct the air out of the indoor portion of the air conditioner unit through the outlet grille in a second direction when the automatic louver assembly is in the second position.

In accordance with another embodiment, an air conditioner unit is provided. The air conditioner unit includes a blower fan. The blower fan includes a blade assembly and a motor connected to the blade assembly. The air conditioner unit also includes an inlet grille upstream of the blower fan and an outlet grille downstream of the blower fan. The air conditioner unit further includes an automatic louver assembly operatively connected to the outlet grille whereby air flowing through the outlet grille is directed in a first direction when the automatic louver assembly is in a first position and the air flowing through the outlet grille is directed in a second direction when the automatic louver assembly is in a second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
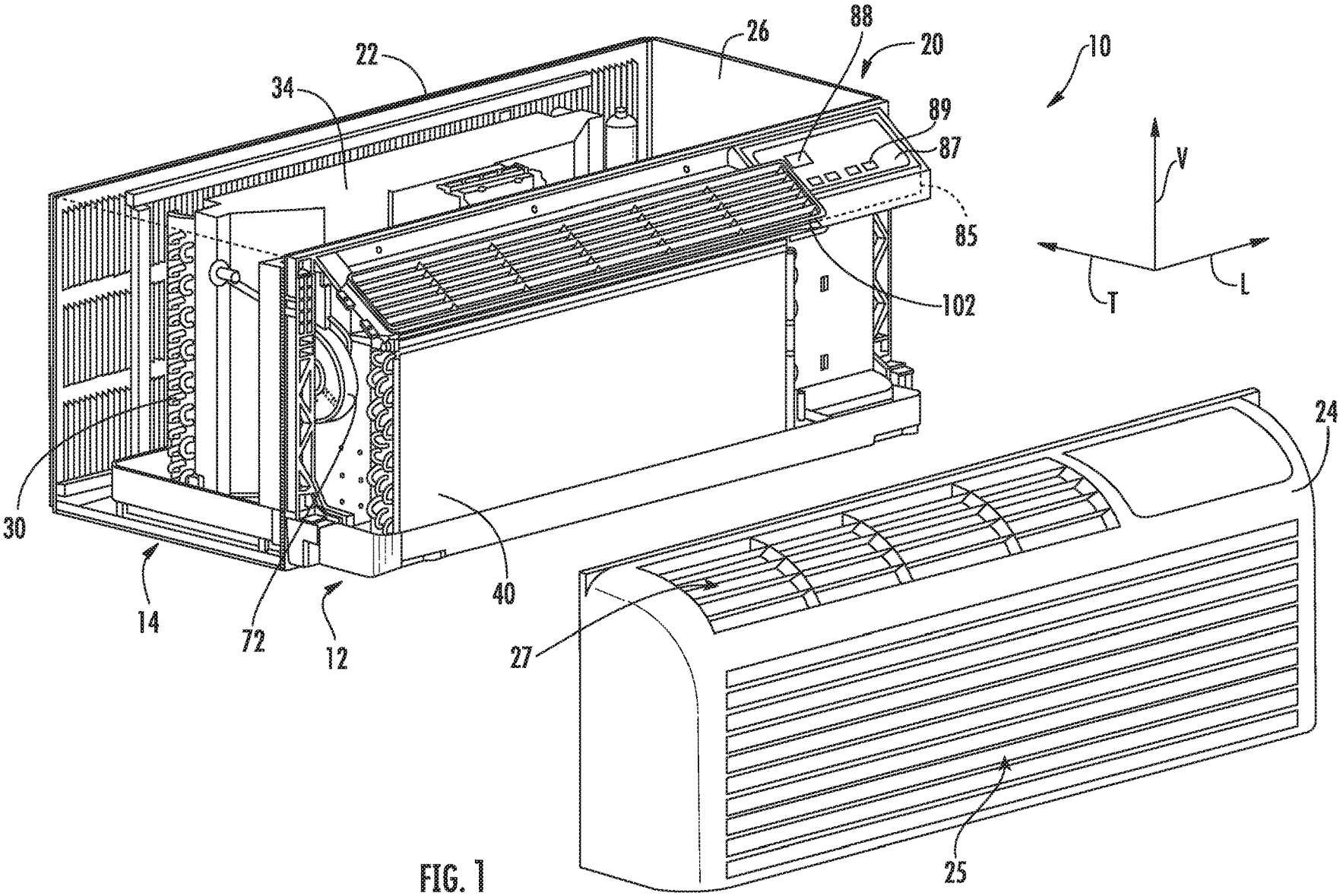
FIG. 1 provides a perspective view of an air conditioner unit, with a room front exploded from a remainder of the air conditioner unit for illustrative purposes, in accordance with one or more embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
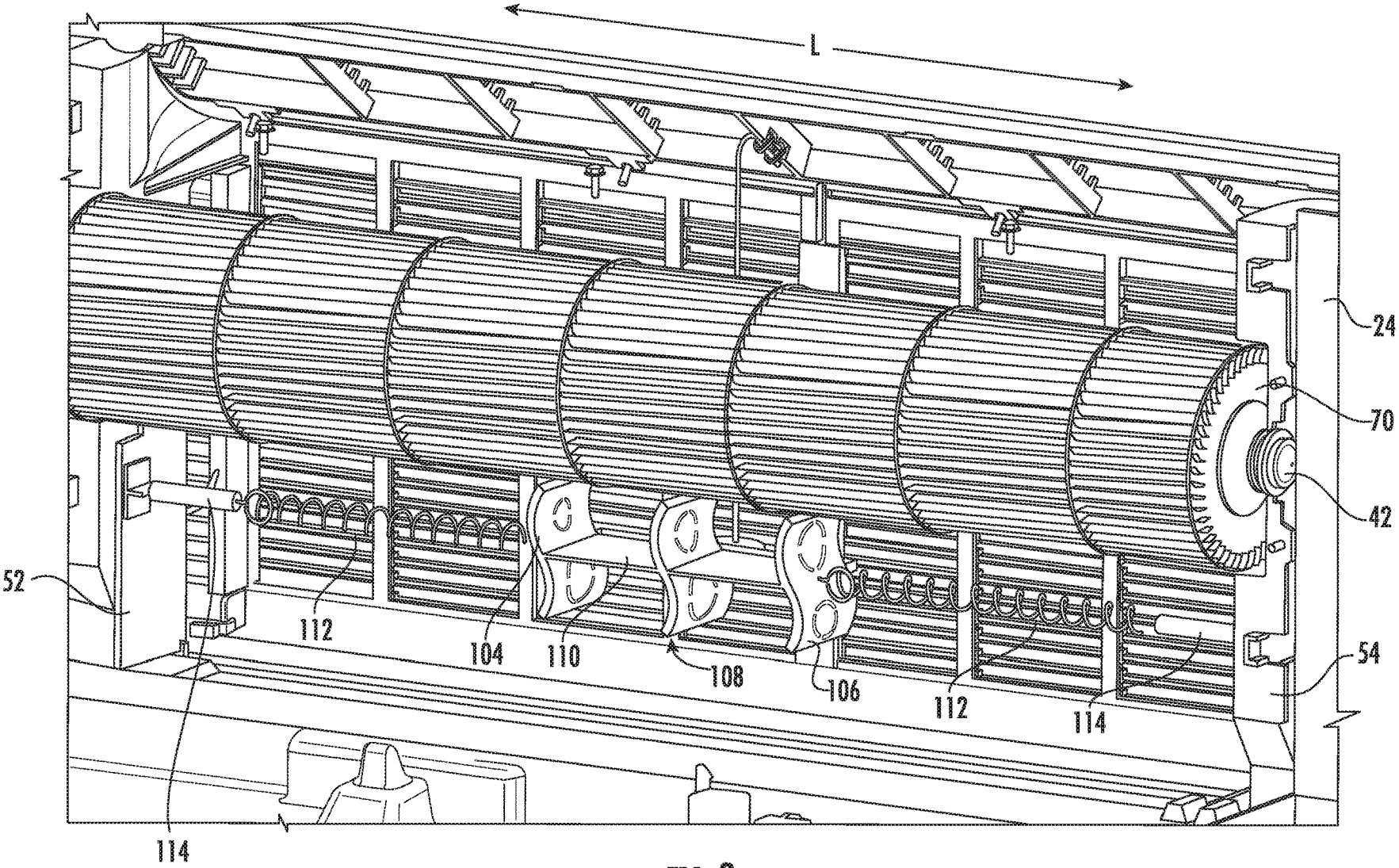
FIG. 2 is a perspective view of components of an indoor portion of an air conditioner unit in accordance with one or more embodiments of the present disclosure.

Referring now to FIGS. 1 and 2, an air conditioner unit 10 is provided. The air conditioner unit 10 is a one-unit type air conditioner, also conventionally referred to as a room air conditioner. The unit 10 includes an indoor portion 12 and an outdoor portion 14, and generally defines a vertical direction V, a lateral direction L, and a transverse direction T. The directions V, L, and T are mutually perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, while the room front 24 is part of the indoor portion 12. Components of the outdoor portion 14, such as an outdoor heat exchanger 30, outdoor fan (not shown), and compressor (not shown) may be housed within the wall sleeve 26. A casing 34 may additionally enclose the outdoor fan, as shown.

The indoor portion 12 may include, for example, an indoor heat exchanger 40, a blower fan 42, and a heating unit (not shown). These components may, for example, be housed behind the room front 24. In at least some embodiments, the unit 10 may also include a reversing valve for reversing a direction of refrigerant flow between the outdoor heat exchanger 30 and the indoor heat exchanger 40 to provide a heat pump operation mode, as is generally understood in the art. Additionally, the room front 24 may include or define an inlet grille 25 and an outlet grille 27.

In exemplary embodiments, blower fan 42 may be a tangential fan. Alternatively, however, any suitable fan type may be utilized. Blower fan 42 may include a blade assembly 70 and a motor 72. The blade assembly 70, which may include one or more blades, may be disposed within the indoor portion 12 of the unit 10. As shown, blade assembly 70 may for example extend along the lateral direction L between a first sidewall 52 and a second sidewall 54. The motor 72 may be connected to the blade assembly 70, such as via a shaft. Operation of the motor 72 may rotate the blades, thus generally operating the blower fan 42. The inlet grille 25 and the outlet grille 27 may provide fluid communication between an ambient environment, e.g., a room, and the indoor portion 12 of the air conditioner unit 10. The inlet grille 25 may be upstream of the blower fan 42 and the outlet grille 27 may be downstream of the blower fan 42. Accordingly, during operation of the blower fan 42, the blower fan 42 may urge air into the indoor portion 12 of the air conditioner unit 10 through the inlet grille 25 and may urge air out of the indoor portion 12 of the air conditioner unit 10 through the outlet grille 27.

The operation of air conditioner unit 10, including the blower fan 42, the outdoor heat exchanger 30, the indoor heat exchanger 40, and other suitable components, may be controlled by a processing device such as a controller 85. Controller 85 may be in operable communication with, e.g., operably connected to (via for example a suitable wired or wireless connection) such components of the air conditioner unit 10. By way of example, the controller 85 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor. It should be understood that, in exemplary embodiments, the controller 85 in accordance with the present disclosure may be operable to perform the various methods steps as disclosed herein.

Unit 10 may additionally include a control panel 87 and one or more user inputs 89, which may be included in control panel 87. The user inputs 89 may be in communication with the controller 85. A user of the unit 10 may interact with the user inputs 89 to operate the unit 10, and user commands may be transmitted between the user inputs 89 and controller 85 to facilitate operation of the unit 10 based on such user commands. A display 88 may additionally be provided in the control panel 87, and may be in communication with the controller 85. Display 88 may, for example, be a touchscreen or other text-readable display screen, or alternatively may simply be a light that can be activated and deactivated as required to provide an indication of, for example, one or more events or settings for the unit 10.

As may be seen in FIGS. 2 through 7, the air conditioner unit 10 may include an automatic louver assembly 100. The automatic louver assembly 100 may include a louver 102. The automatic louver assembly 100, e.g., the louver 102 thereof, may be operatively connected to the outlet grille 27, e.g., the louver 102 may be positioned between the blower fan 42 and the outlet grille 27, as in the illustrated example embodiments. The automatic louver assembly 100 may be movable along the lateral direction L between a first position (FIG. 6) and a second position (FIG. 7), whereby the air blowing out of the indoor portion 12 of the air conditioner unit 10 through the outlet grille 27 is directed in a first direction (indicated by arrows 200 in FIG. 6) when the automatic louver assembly 100 is in the first position and is directed in a second direction (indicated by arrows 202 in FIG. 7) when the automatic louver assembly 100 is in the second position. Thus, it will be understood that the louver 102 forms an angle with the outlet grille 27 and the angle defined by the louver 102 and the outlet grille 27 determines the direction of the air blown out of the outlet grille 27. For example, the louver 102 and the outlet grille 27 may define a first oblique angle when the automatic louver assembly 100 is in the first position and may define a second oblique angle, different from the first angle, when the automatic louver assembly 100 is in the second position.

The automatic louver assembly 100 may be automatic, e.g., may not require manual operation or adjustment, and may also not require electrical power to actuate or move the louver 102 between the first and second positions. For example, the automatic louver assembly 100 may be pneumatically actuated, such as by directing a flow of fluid to impinge on a selected portion of the automatic louver assembly 100. As may be seen, e.g., in FIGS. 2 and 3, the automatic louver assembly may include a first cup 104 which is concave in a first lateral orientation and a second cup 106 which is concave in a second lateral orientation opposite the first lateral orientation. In such embodiments, the automatic louver assembly 100 may be movable from a neutral position (FIGS. 2, 3, and 5) to the first position (FIG. 6) by directing a fluid flow 1000 (FIGS. 6 and 7) to impinge on the first cup 104 along the first lateral orientation, as indicated by arrow 204 in FIG. 5, and the automatic louver assembly 100 may be movable from the neutral position to the second position (FIG. 7) by directing the fluid flow 1000 to impinge on the second cup 106 along the second lateral orientation, as indicated by arrow 206 in FIG. 5. The fluid flow 1000 may be any suitable fluid flow for actuating the automatic louver assembly 100. For example, the fluid flow may be a flow of pressurized air from one or more components of the air conditioner unit 10, e.g., the compressor, the indoor fan 42, or the outdoor fan, and the air conditioner unit 10 may include a valve, such as a three-way valve or a shutoff valve, configured to selectively direct the fluid flow 1000 in the first lateral orientation 204 and the second lateral orientation 206. The structure and function of such valves are understood by those of ordinary skill in the art and, as such, are not shown or described in greater detail herein for the sake of brevity and clarity.

The first cup 104 and the second cup 106 may be joined such that the first cup 104 and the second cup 106 collectively define a spline-shaped body 108. In at least some embodiments, a plurality of spline-shaped bodies 108 may be provided, such as three spline-shaped bodies in the illustrated example embodiments. In such embodiments, the spline-shaped bodies 108 may be aligned, such as aligned along the vertical direction V and along the transverse direction T, while being spaced apart along the lateral direction L. In particular, the first cup 104 of each spline-shaped body 108 of the plurality of spline-shaped bodies 108 may be aligned with every other first cup 104 along the vertical direction V and along the transverse direction T while being spaced apart from the other first cups 104 of the plurality of spline-shaped bodies 108 along the lateral direction L, and the second cup 106 of each spline-shaped body 108 of the plurality of spline-shaped bodies 108 may be aligned with every other second cup 106 along the vertical direction V and along the transverse direction T while being spaced apart from the other second cups 106 of the plurality of spline-shaped bodies 108 along the lateral direction L.

Figure 3:
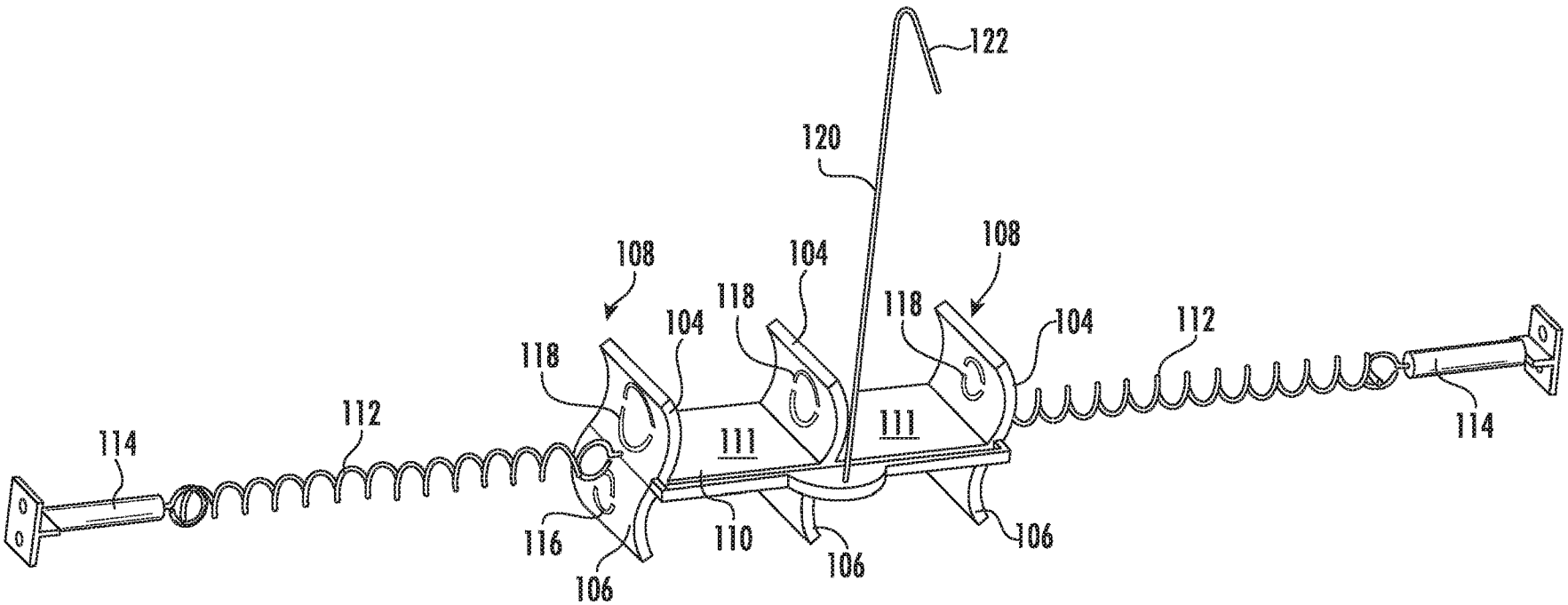
FIG. 3 is a perspective view of a portion of an automatic louver for an air conditioner unit in accordance with one or more embodiments of the present disclosure.
Figure 5:
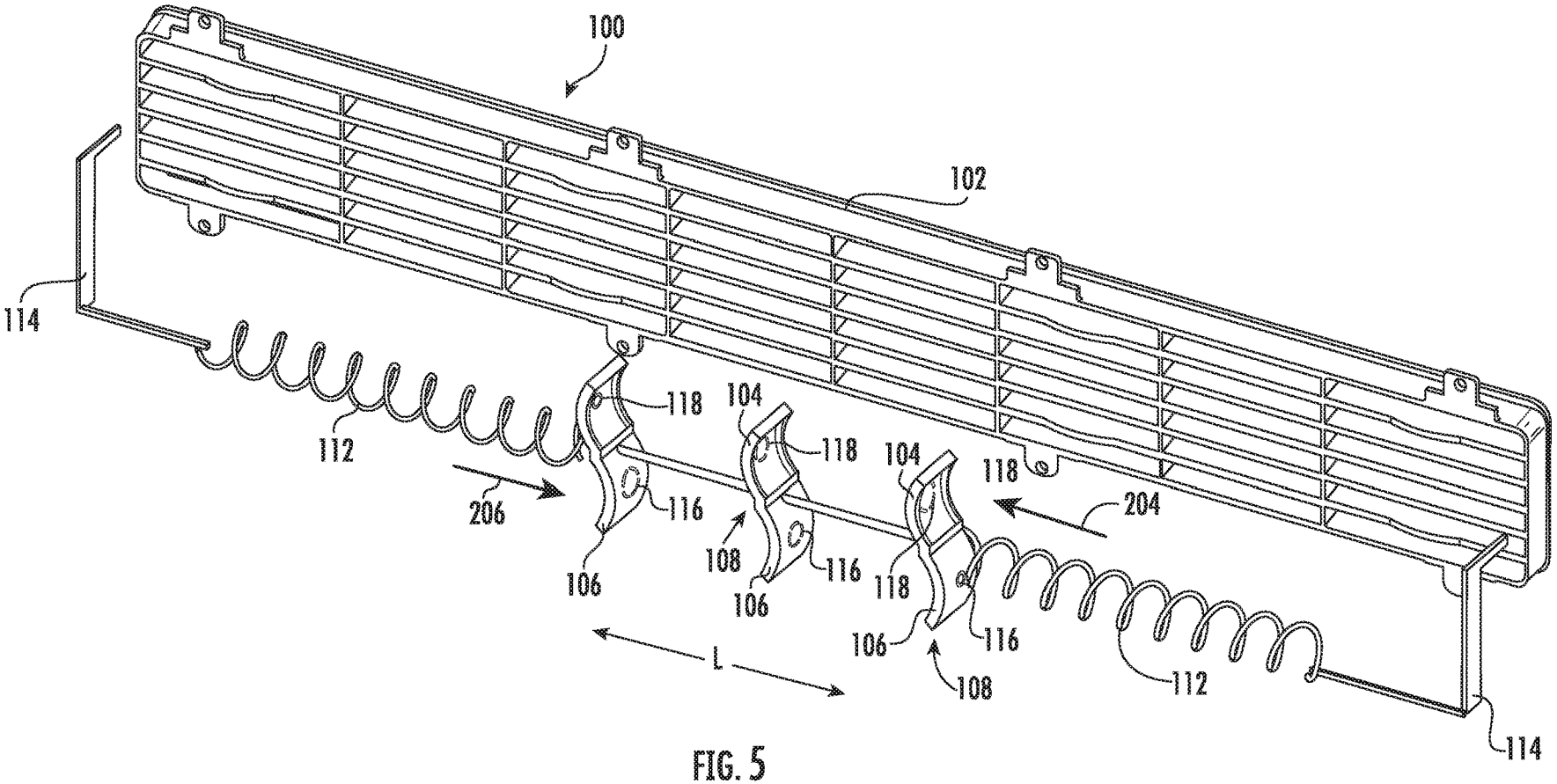
FIG. 5 is a perspective view of an automatic louver for an air conditioner unit in accordance with one or more embodiments of the present disclosure.

In embodiments where a plurality of spline-shaped bodies 108 are provided, each spline-shaped body 108 of the plurality of spline-shaped bodies 108 will include a first cup 104 and a second cup 106. In order to permit or promote the fluid flow 1000 to pass from one spline-shaped body 108 to a next adjacent spline-shaped body 108, the spline-shaped bodies 108 may include slots 116 and/or 118. For example, each spline-shaped body 108 may include a first cup 104 and a second cup 106 with a slot 118 in the first cup 104 and a slot 116 in the second cup 106. Further, in order to ensure the fluid flow 1000 through each slot 116 or 118 impinges on the next cup 104 or 106, the slots are generally offset, e.g., not aligned, such as not aligned along at least two of the lateral direction L, the vertical direction V, and/or the transverse direction T, such as offset or not aligned along all three directions. For example, the slot 118 in each first cup 104 may be not aligned with (e.g., offset from) the slot 118 in each adjacent first cup 104, and the slot 116 in each second cup 106 may be not aligned with (e.g., offset from) the slot 116 in each adjacent second cup 106. In various embodiments, any suitable number, size, and shape of slots 116 and/or 118 may be provided. For example, as illustrated in FIGS. 2, 3, and 5, the slots 116 and 118 may be arcuate and a plurality of slots 116, 118 may be provided in each respective first cup 104 or second cup 106, such as four arcuate slots 116 or 118 in each cup 104 or 106, as illustrated, where the slots 116 or 118 in each cup 104 or 106 are arranged to generally form a circle. Also as illustrated, the slots 116 or 118 may vary in size from one spline-shaped body 108 to the next spline-shaped body 108, e.g., where an upstream spline-shaped body 108 includes larger slots than an adjacent spline-shaped body 108 downstream thereof. More specifically, it should be noted that an upstream spline-shaped body 108 with respect to the first lateral orientation 204 will be downstream with respect to the second lateral orientation 206, such that the first cup 104 of a first spline-shaped body 108 may have larger slots 118 than the first cup 104 of the adjacent spline-shaped body 108 downstream of the first spline-shaped body 108 along the first lateral orientation 204, while the second cup 106 of the first spline-shaped body 108 may have smaller slots 116 than the second cup 106 of the adjacent spline-shaped body 108, where the adjacent spline-shaped body 108 is upstream of the first spline-shaped body 108 along the second lateral orientation 206. In other embodiments, the slots 116 and/or 118 may be the same size and may be offset. The shape of the slots 116 and/or 118 may vary as well. For example, the slots 116 and/or 118 may be linear or polygonal and/or the shape of the slots 116 and/or 118 may vary from one body 108 to the next, e.g., an upstream body 108 may include arcuate slots while an adjacent, downstream body includes one or more linear slots, etc., among other possible variations and combinations.

In some embodiments, as illustrated in FIGS. 2 and 3, the plurality of spline-shaped bodies 108 may be joined by a platform 110. In such embodiments, the platform 110 may include or define a stop surface 111 positioned between the first cup 104 and the second cup 106 of each spline-shaped body 108 to prevent cross-flow between the first cups 104 and the second cups 106 of either the same body 108 or adjacent bodies 108.

The automatic louver assembly 100 may be mounted at any suitable location within the air conditioner unit 10. For example, as illustrated in FIG. 2, the automatic louver assembly 100 may include a first mounting bracket 114 and a second mounting bracket 114 at opposite ends of the automatic louver assembly 100. Each mounting bracket 114 may be mounted to one of the sidewalls 52, 54. For example, the mounting brackets 114 may be brazed or welded in place (e.g., to the sidewalls 52 and 54, or to another suitable mounting location within the air conditioner unit 10), or may be received within a slot, or may be attached with mechanical fasteners, or any other suitable mounting means may be employed, including combinations of two or more of the foregoing examples.

Figure 6:
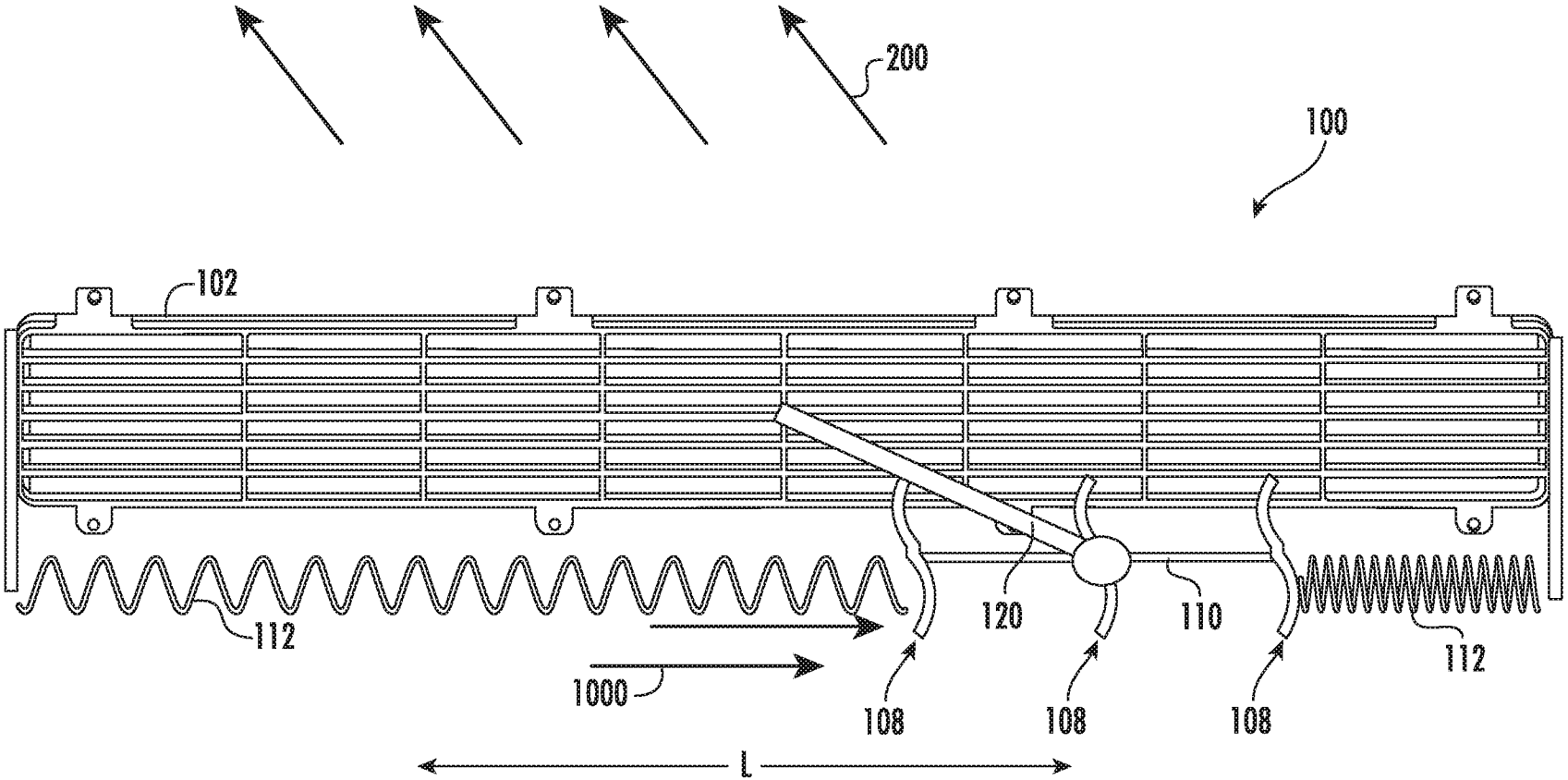
FIG. 6 schematically depicts the automatic louver of FIG. 5 in a first position providing air flow output in a first direction.
Figure 7:
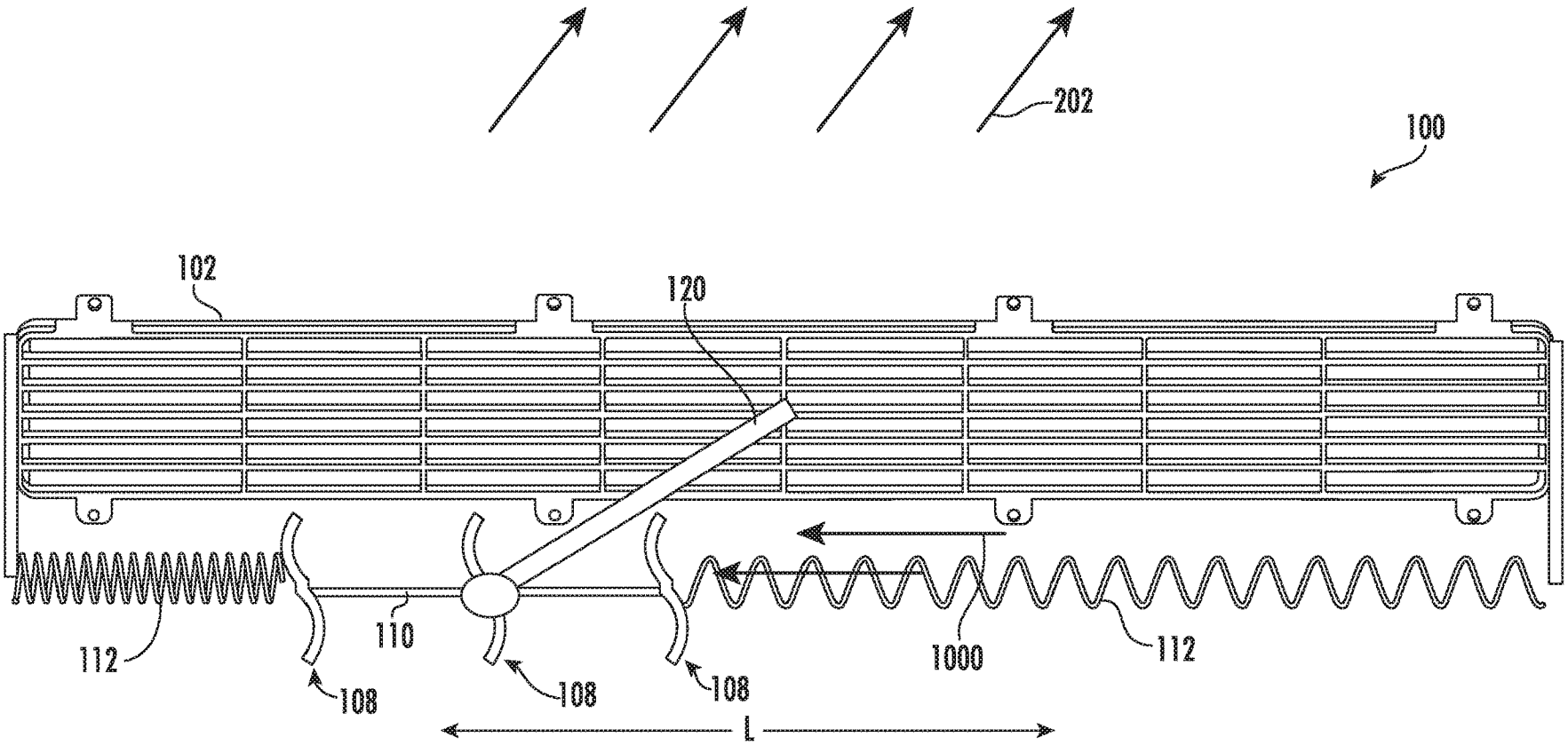
FIG. 7 schematically depicts the automatic louver of FIG. 5 in a second position providing air flow output in a second direction.

The automatic louver assembly 100 may include a first biasing member 112 coupled to the first cup 104 and the second cup 106, e.g., to the one or more spline-shaped bodies 108, and a second biasing member 112 coupled to the first cup(s) 104 and the second cup(s) 106 of the one or more spline-shaped bodies 108 opposite the first biasing member 112. The biasing members 112 may be configured to return the automatic louver assembly 100 to the neutral position when the fluid flow 1000 is not present or active. For example, the first biasing member 112 may be configured to bias the automatic louver assembly 100 to the neutral position from the first position and the second biasing member 112 may be configured to bias the automatic louver assembly 100 to the neutral position from the second position. In some embodiments, the biasing members 112 may be coil springs, as illustrated, e.g., low-tension helical springs. Accordingly, as shown in FIG. 6, when the automatic louver assembly 100 is in the first position, the first biasing member 112 is in tension and will bias the automatic louver assembly 100 back to the neutral position, e.g., to the left on the page in FIG. 6, such as when the fluid flow 1000 is not provided. Similarly, as shown in FIG. 7, when the automatic louver assembly 100 is in the second position, the second biasing member 112 is in tension and will bias the automatic louver assembly 100 back to the neutral position, e.g., to the right on the page in FIG. 7, such as when the fluid flow 1000 is not provided, e.g., is not active.

Figure 4:
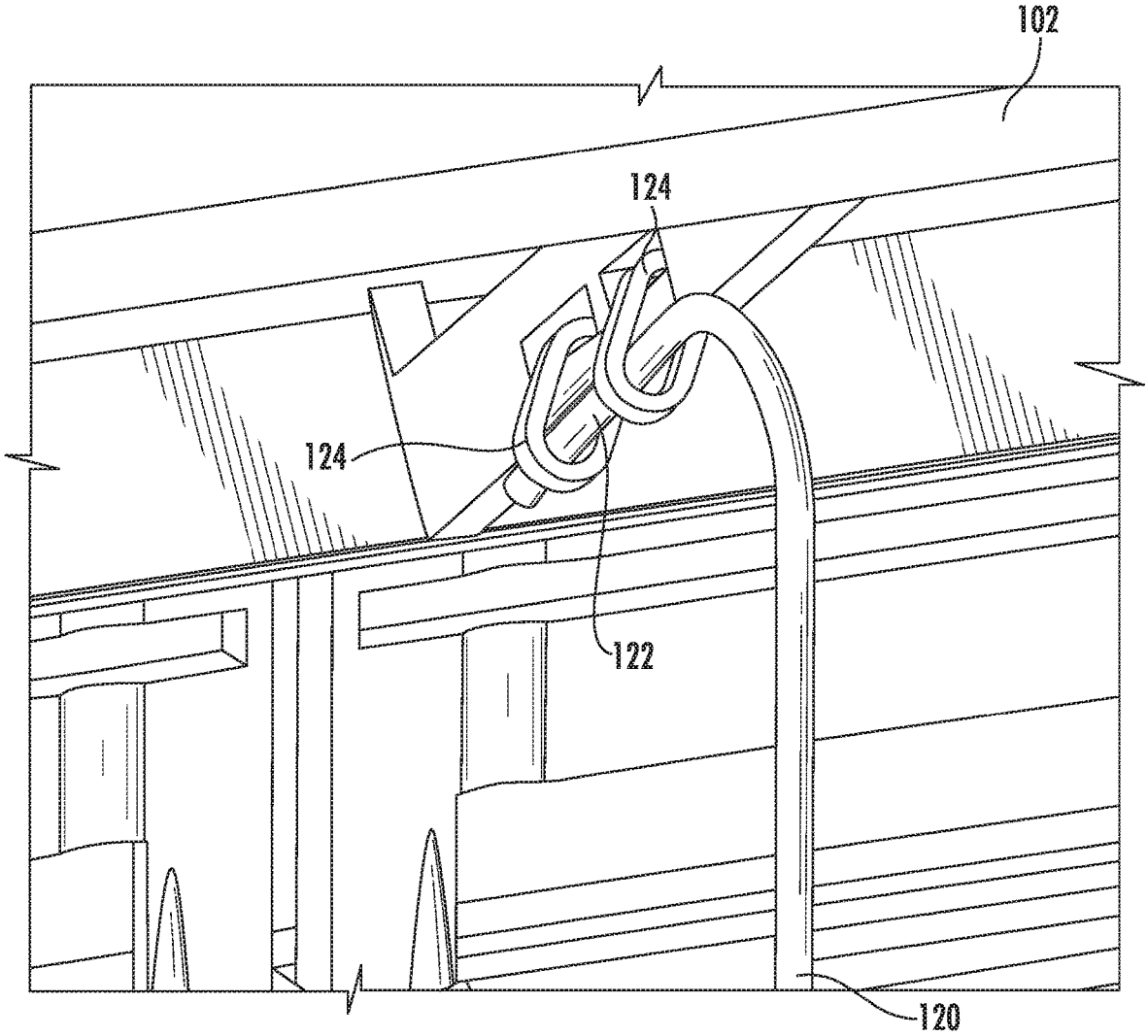
FIG. 4 is an enlarged view of a portion of FIG. 2.

The spline-shaped bodies 108 may be connected to the louver 102 by an arm or rod 120 with a hook 122 at a distal (e.g., distal from the platform 110 and/or bodies 108) end of the rod 120. As shown in FIG. 4, the hook 122 may be engaged with, e.g., received in, one or more loops 124 on the louver 102, such that movement of the spline-shaped bodies 108 along the lateral direction L is transferred to the louver 102.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical direction, a lateral direction, and a transverse direction, the vertical direction, the lateral direction, and the transverse direction being mutually perpendicular, the air conditioner unit comprising:

an inlet grille and an outlet grille providing fluid communication between an indoor portion of the air conditioner and an ambient environment;

a blower fan positioned in the indoor portion of the air conditioner unit, the blower fan operable to urge air into the indoor portion of the air conditioner unit through the inlet grille and to urge air out of the indoor portion of the air conditioner unit through the outlet grille; and an automatic louver assembly operatively connected to the outlet grille and movable along the lateral direction between a first position and a second position, the automatic louver assembly configured to direct the air out of the indoor portion of the air conditioner unit through the outlet grille in a first direction when the automatic louver assembly is in the first position and to direct the air out of the indoor portion of the air conditioner unit through the outlet grille in a second direction when the automatic louver assembly is in the second position, wherein the automatic louver assembly comprises a first cup which is concave in a first lateral orientation and a second cup which is concave in a second lateral orientation opposite the first lateral orientation, and wherein the automatic louver assembly is movable from a neutral position to the first position by directing a fluid flow to impinge on the first cup along the first lateral orientation and the automatic louver assembly is movable from the neutral position to the second position by directing the fluid flow to impinge on the second cup along the second lateral orientation.

2. The air conditioner unit of claim 1, wherein the automatic louver assembly comprises a louver, the louver disposed at a first angle relative to the outlet grille when the automatic louver assembly is in the first position, the first angle oblique to the lateral direction and the louver disposed at a second angle relative to the outlet grille which is different from the first angle and oblique to the lateral direction when the automatic louver assembly is in the second position.

3. The air conditioner unit of claim 1, further comprising a valve configured to selectively direct the fluid flow in the first lateral orientation and the second lateral orientation.

4. The air conditioner unit of claim 1, wherein the fluid flow is a flow of pressurized air.

5. The air conditioner unit of claim 1, further comprising a first biasing member coupled to the first cup and the second cup and a second biasing member coupled to the first cup and the second cup opposite the first biasing member, the first biasing member configured to bias the automatic louver assembly to the neutral position from the first position and the second biasing member configured to bias the automatic louver assembly to the neutral position from the second position.

6. The air conditioner unit of claim 1, wherein the first cup is joined to the second cup, the first cup and the second cup defining a spline-shaped body, further comprising a plurality of spline-shaped bodies aligned along the lateral direction.

7. The air conditioner unit of claim 6, wherein each spline-shaped body of the plurality of spline-shaped bodies comprises a first cup and a second cup with a slot in each first cup and a slot in each second cup, wherein the slot in each first cup is not aligned with the slot in an adjacent first cup, and wherein the slot in each second cup is not aligned with the slot in an adjacent second cup.

8. The air conditioner unit of claim 6, wherein the plurality of spline-shaped bodies are joined by a platform, the platform comprising stop surface positioned between the first cups and the second cups to prevent cross-flow between the first cups and the second cups.

9. An air conditioner unit comprising:

a blower fan, the blower fan comprising a blade assembly and a motor connected to the blade assembly;

an inlet grille upstream of the blower fan;

an outlet grille downstream of the blower fan; and an automatic louver assembly operatively connected to the outlet grille whereby air flowing through the outlet grille is directed in a first direction when the automatic louver assembly is in a first position and the air flowing through the outlet grille is directed in a second direction when the automatic louver assembly is in a second position wherein the air conditioner unit defines a vertical direction, a lateral direction, and a transverse direction, the vertical direction, the lateral direction, and the transverse direction being mutually perpendicular, wherein the outlet grille extends generally along the lateral direction, and wherein the automatic louver assembly comprises a louver, the louver disposed at a first angle oblique to the lateral direction when the automatic louver assembly is in the first position and the louver disposed at a second angle which is different from the first angle and oblique to the lateral direction when the automatic louver assembly is in the second position, wherein the automatic louver assembly comprises a first cup which is concave in a first lateral orientation and a second cup which is concave in a second lateral orientation opposite the first lateral orientation.

10. The air conditioner unit of claim 9, wherein the first cup and the second cup are connected to the louver, whereby the automatic louver assembly is movable from a neutral position to the first position by directing a fluid flow to impinge on the first cup along the first lateral orientation and the automatic louver assembly is movable from the neutral position to the second position by directing the fluid flow to impinge on the second cup along the second lateral orientation.

11. The air conditioner unit of claim 10, further comprising a first biasing member coupled to the first cup and the second cup and a second biasing member coupled to the first cup and the second cup opposite the first biasing member, the first biasing member configured to bias the automatic louver assembly to the neutral position from the first position and the second biasing member configured to bias the automatic louver assembly to the neutral position from the second position.

12. The air conditioner unit of claim 9, wherein the first cup is joined to the second cup, the first cup and the second cup defining a spline-shaped body.

13. The air conditioner unit of claim 9, wherein the first cup is one of a first plurality of cups, each cup of the first plurality of cups concave in the first lateral orientation, and wherein the second cup is one of a second plurality of cups, each cup of the second plurality of cups concave in the second lateral orientation.

14. The air conditioner unit of claim 13, wherein the cups of the first plurality of cups are mutually aligned along the vertical and transverse directions and wherein the cups of the second plurality of cups are mutually aligned along the vertical and transverse directions.

15. The air conditioner unit of claim 14, wherein each cup of the first plurality of cups comprises a slot and the slot in each cup of the first plurality of cups is not aligned with the slot in an adjacent cup of the first plurality of cups and wherein each cup of the second plurality of cups comprises a slot and the slot in each cup of the second plurality of cups is not aligned with the slot in an adjacent cup of the second plurality of cups.

16. The air conditioner unit of claim 9, further comprising a stop surface positioned between the first cup and the second cup to prevent cross-flow between the first cup and the second cup.

* * * * *